US012024957B2

(12) United States Patent
Killeen et al.

(10) Patent No.: US 12,024,957 B2
(45) Date of Patent: Jul. 2, 2024

(54) CONDUCTOR ASSEMBLY AND METHODS

(71) Applicant: MAKO OFFSHORE LTD, Rothienorman (GB)

(72) Inventors: Michael Killeen, Rothienorman (GB); Elizabeth Killeen, Rothienorman (GB); Ewen Cameron, Bridge of Don (GB)

(73) Assignee: Mako Offshore Ltd., Rothienorman (GB)

( * ) Notice: Subject to any disclaimer, the term of this patent is extended or adjusted under 35 U.S.C. 154(b) by 89 days.

(21) Appl. No.: 17/769,733

(22) PCT Filed: Oct. 14, 2020

(86) PCT No.: PCT/GB2020/052587
§ 371 (c)(1),
(2) Date: Apr. 16, 2022

(87) PCT Pub. No.: WO2021/079096
PCT Pub. Date: Apr. 29, 2021

(65) Prior Publication Data

US 2022/0381095 A1 Dec. 1, 2022

(30) Foreign Application Priority Data

Oct. 21, 2019 (GB) ..... 1915215

(51) Int. Cl.
*E21B 17/10* (2006.01)

(52) U.S. Cl.
CPC ..... *E21B 17/105* (2013.01); *E21B 17/1078* (2013.01)

(58) Field of Classification Search
CPC . E21B 17/1042; E21B 17/105; E21B 17/1078
See application file for complete search history.

(56) References Cited

U.S. PATENT DOCUMENTS 4,784,224 A * 11/1988 Leach ..... E21B 33/035 166/85.5
5,873,677 A * 2/1999 Davies ..... E21B 17/017 285/216

(Continued)

FOREIGN PATENT DOCUMENTS

GB 1446228 8/1976
GB 2487736 8/2012

(Continued)

OTHER PUBLICATIONS

UK Intellectual Property Office, Examination Report in GB2205874.7, dated May 30, 2023.

(Continued)

*Primary Examiner* — Matthew R Buck
(74) *Attorney, Agent, or Firm* — Dorton & Willis LLP; Ryan Willis

(57) ABSTRACT

A conductor assembly comprising a conductor of an offshore platform and a guide surrounding the conductor. The guide extending from an upper end to a lower end and having a main portion therebetween, a stabilising body defining a bore extending therethrough, the conductor extending through the bore of the stabilising body, the stabilising body provided between the conductor and the guide optionally the stabilising body comprising an inner body and an outer body. In this way, the conductor is allowed to move vertically within the guide with the only moving surfaces in contact being an outer surface of the inner body and the inner surface of the outer body, thus mitigating or eliminating abrasion of the conductor and/or guide.

29 Claims, 10 Drawing Sheets

(56) References Cited

U.S. PATENT DOCUMENTS

| | | | | |
|---|---|---|---|---|
| 6,032,748 | A | 3/2000 | Debray et al. | |
| 9,494,034 | B2 | 11/2016 | Martin et al. | |
| 2003/0164236 | A1* | 9/2003 | Thornton | E21B 17/1042 166/278 |
| 2004/0197152 | A1* | 10/2004 | Beard | E21B 19/004 405/224.2 |
| 2008/0164019 | A1* | 7/2008 | Angman | E21B 17/1078 166/241.6 |
| 2009/0223673 | A1* | 9/2009 | Bartlett | E21B 17/01 166/345 |
| 2013/0195558 | A1* | 8/2013 | Storksen | E21B 17/1078 405/184.4 |

FOREIGN PATENT DOCUMENTS

| | | | | |
|---|---|---|---|---|
| GB | 2494991 | | 3/2013 | |
| GB | 2518417 | | 3/2015 | |
| GB | 1915215.6 | | 3/2020 | |
| WO | WO-2007026149 | A1 * | 3/2007 | E21B 17/10 |
| WO | 2012/021066 | | 2/2012 | |
| WO | 2014/126481 | | 8/2014 | |
| WO | 2015040367 | | 3/2015 | |
| WO | 2018/052411 | | 3/2018 | |
| WO | 2021/079096 | | 4/2021 | |

OTHER PUBLICATIONS

UK Intellectual Property Office, Examination Report in GB2205874.7, dated Jan. 26, 2023.

* cited by examiner

CONDUCTOR ASSEMBLY AND METHODS

CROSS REFERENCE TO RELATED APPLICATIONS

This application is a national stage application of Patent Cooperation Treaty Application Serial No. PCT/GB2020/052587, filed Oct. 14, 2020, titled "Conductor Assembly and Methods," which claimed priority under 35 U.S.C. § 119 to United Kingdom Patent Application Serial No. 1915215.6, filed on Oct. 21, 2019, the disclosure of which is hereby incorporated by reference.

This invention relates to a conductor assembly and methods for centralisation of conductor pipes, sometimes referred to as conductors, and caissons in offshore installations.

BACKGROUND

Conductor pipes provide a key structural foundation in offshore installations. They are driven into the soil at the seabed having passed through conductor guides, which are typically welded to the structure of an installation. A guide may be used to restrict the lateral motion caused by environmental loading and therefore prolong the lifespan of the conductor. In addition, the guide ensures that the conductor does not physically interact with other nearby conductors, or indeed any other structure, which could damage the pipe, and/or the structure. A conductor guide usually has a form of a hollow cylinder with a cross-sectional diameter substantially larger than that of the conductor pipe/caisson, and with at least one conical end. It is known to stabilise the conductor pipe/caisson within the guide by means of a centraliser, welded or bolted within the annulus between the outer surface of the conductor pipe and the inner surface of the guide. Conductor guides can be located either subsea or topside in a position out of the water.

Conventional centralisers are susceptible to fatigue failure due to cyclical loading of the waves and currents. Once a centraliser fails, the conductor pipe/caisson is free to move laterally within the guide, which may lead to vibration and/or impact damage of the conductor/caisson and, consequently, their failure. Fracturing and/or fatigue of the guide may also occur, decreasing the guide's ability to stabilise the conductor pipe/caisson.

Known solutions to centraliser failure employ shims, chocking the conductor pipe/caisson within the guide, ultrasonically welded bags filled with polymer or steel on steel replacement centralisers, usually in form of multi-part shells. WO2012/021066, the disclosure of which is hereby incorporated herein in its entirety by this reference, describes a support body for positioning in an annulus between a conductor and a guide, equipped with a lock that is moveable between a passive position and an active position where the lock engages with the conductor guide, the lock member connected to a frame cast in an elastic material of the support body. Whilst generally satisfactory, the inventor of the present invention has recognised that there are shortcomings in the prior-art solutions. It is in this context that the present invention has been devised.

As mentioned previously, conductor pipes are often referred to as conductors. In the interests of brevity, the term conductor will be used to refer to conductor pipes. Furthermore, also in the interest of brevity, in what follows, references are made specifically to systems and methods for centralising conductors within guides; however, they may all equally be applied to caissons. Centralisation of conductors in the guides may also be referred to as stabilisation of the conductors in the guides. Furthermore, also in the interest of brevity, references to the conductor run through the guide are made when referring to a portion of the conductor that is run through the said guide, noting that the full length of the conductor is normally much greater that the full length of the guide. Unless otherwise stated, references to diameters of the stabilising body, the guide, portions thereof or bores defined therein, should be understood as cross-sectional diameters.

BRIEF SUMMARY OF THE INVENTION

According to a first aspect of the invention, there is provided a conductor assembly comprising a conductor of an offshore platform, a guide surrounding the conductor, the guide extending from an upper end to a lower end and having a main portion therebetween, a stabilising body defining a bore extending therethrough, the conductor extending through the bore of the stabilising body, the stabilising body provided between the conductor and the guide and optionally the stabilising body comprising an inner body and an outer body.

The stabilising body may be configured to substantially fill the annulus between the guide and the conductor, at least along part of the length thereof, the length defined in the direction along the conductor.

The stabilising body may be configured to substantially fill the cross-section of the annulus, optionally at least 70%, normally at least 80%, preferably at least 90% of the cross-section of the annulus, at least along part of the length thereof, normally at least along a quarter of the length thereof.

An advantage of some embodiments of the present invention is that the stabilising body may be configured to substantially fill at the annulus, at least along part the length thereof, thereby making use of the full stabilising capability of the guide, or at least of the part thereof.

The stabilising body may comprise a portion with a diameter not larger than that the smallest diameter of the guide, and a further portion with a diameter larger than the smallest diameter of the guide.

The stabilising body may be placed in an offshore system wherein the guide and the portion of the conductor run therethrough are located topside and/or subsea.

According to a second aspect of the present invention there is provided a stabilising body suitable for stabilising a conductor of an offshore system in a guide, the stabilising body comprising:

- a main cylindrical portion;
- a radially extending upper end;
- a tail section comprising a radially extending lower end;
- the main cylindrical portion located between the upper and the lower end;
- the main cylindrical portion having a diameter smaller than the diameter of the upper end and smaller than the diameter of the lower end.

The stabilising body may comprise one or more material components. The one or more material components normally comprise elastic material, preferably elastic polyurethane. The one or more material components may be referred to as elastic material components. The elastic polyurethane may be formed of a mixture comprising a polyol and an isocyanate or diisocyanate. The polyol normally may contain additives and/or catalysts. If more than one elastic polyurethane component is present, the ratios of the polyol to the isocyanate (or diisocyanate) in the respective mixtures may not be the same. An example of a suitable compound is Elasturan® by BASF. The one or more material components may be polymeric. A chain extender may be added to the one or more material components.

An advantage of some embodiments of the present invention is that the elasticity of the elastic polyurethane may allow for an easy and safe installation thereof. Furthermore, the durability of the elastic polyurethane and its resistance to corrosion may eliminate the need of maintenance of the stabilising body post-installation. The addition of the chain extender to the one or more material components may increase the molecular weight and may improve the mechanical properties of the stabilising bodies.

The mixture from which the stabilising body is formed may be referred to as a stabilising compound The stabilising body may be referred to as a centralising body and the mixture from which it is formed may be referred to as centralising mixture.

If more than one material component is present, the different components may be the same. Optionally, the different components may be different. The different components may have different mechanical properties, such as elasticity. For example, an inner part of the stabilising body (positioned proximally to the surface of the conductor) may comprise a first material component and an outer part of the stabilising body (positioned proximally to the inner surface of the guide) may comprise a second material component. The second material component may be more elastic than the first material component. The mechanical properties of the one or more material components may be quantified, for example, by: hardness, elongation at break, tensile strength, compressive strength, compression set, elastic modulus, abrasion resistance, water uptake and/or fatigue life. The one or more material component may have a hardness shore of at least 60 to 90A, optionally 65-85A. Certain embodiments have a hardness shore of at least 70A and optionally at most 100A, optionally between 80A and 90A. The one or more material component may have a tensile strength of at least 10 $N/mm^2$ and optionally at most 100 $N/mm^2$, normally less than 50 $N/mm^2$, preferably less than 20 $N/mm^2$. An example of a suitable material component is one with hardness shore of 85A and/or tensile strength of 12.5 $N/mm^2$.

The one or more material component may comprise a polyurethane foam, preferably formed of a mixture comprising a polyol, an isocyanate (or diisocyanate) and water. The one or more elastic material may be buoyant in water, especially sea water.

An advantage of some embodiments of the present invention is that, when the stabilising body comprising polyurethane foam is used subsea, the buoyancy of the foam may reduce the weight of the stabilising body in water, thereby allowing for an easier installation process and improving the safety of the personnel that may be involved therein, such as divers.

The stabilising body may comprise at least one sensor device.

The at least one sensor device may collect data related to the integrity of the system. For example, the data may include the wall thickness of the conductor and/or the guide. The at least one sensor device may be designed and/or configured to detect wall loss, including general wall loss and/or other damages such as pitting. The at least one sensor may include a sensor to measure the outer diameter of the stabilising body and thus monitor physical changes such as wear, abrasion or other material loss during service, for example ultrasonic technique such as Pulse Echo. The at least one sensor device may comprise an ultrasonic transmitter or transducer. The at least one sensor device may comprise a phased array probe comprising a plurality of ultrasonic transmitters or transducers. Ultrasonic transmitters or transducers may be used especially in a stabilising body for use in a subsea system. The at least one sensor device may comprise a material inspection sensor, preferably an electromagnetic acoustic transmitter or transducer (EMAT). The at least one sensor device may comprise a Phased Array EMAT. The at least one sensor device may comprise a pulsed eddy current (PEC) sensor. The at least one sensor device may comprise one or more other wireless transmitters such as acoustic, Radio Frequency and/or Free-Space Optical connection.

The at least one sensor device may collect data related to the motion of the system, for example the lateral motion of the conductor within the guide (substantially perpendicular to the direction defined along the length of the conductor). The at least one sensor device may comprise a motion sensor, for example an accelerometer.

If the stabilising body comprises more than one sensor device, the sensor devices may be of the same type or of different types.

The at least one sensor device may be at least partially enclosed within the stabilising body. The at least one sensor device may be substantially enclosed within the stabilising body. The at least one sensor device may be fully enclosed within the stabilising body. The at least one sensor device may be capable of wireless communication.

The stabilising body may comprise, or be positioned proximally to, an inspection instrument. The inspection instrument may be ultrasonic. The inspection instrument may comprise a transmitter and/or a receiver. The inspection instrument may be configured to communicate with the one or more sensor devices. The inspection instrument may be enclosed in a housing. The housing may be an ATEX housing. The housing may be a waterproof housing. Preferably, the ATEX housing is used in topside locations and the waterproof housing in subsea locations. The inspection instrument and/or the at least one sensor devices may be powered by a battery, preferably an ATEX battery. The battery may be provided proximally to the stabilising body or as part of thereof. Alternatively, the at least one sensor devices may be powered via one or more cables to the offshore installation. The one or more cables may be referred to as one or more umbilical cables. The one or more umbilical cables may also be used to provide/receive communications to/from the sensor devices. Thus, the one or more sensor may be provided with a wired connection from which to collect data from the one or more sensors. This data collection connection point may also be used to power the one or more sensors using, for example, a power and ethernet connection. This connection point is preferably at a minimum Ingress Protection (IP) rated to IP61.

The inspection instrument may be part of a wireless communication system comprising at least one of the one or more sensor devices, an offshore transmitter/receiver and an onshore transmitter/receiver. The wireless communication system may or may not be a mesh network. The wireless communication system may allow multiple paths of signal transfer. The inspection instrument may be configured to communicate signals between the one or more sensors and the offshore receiver, preferably a 4G receiver (e.g. a modem or a repeater), normally connected to the 4G LTE network of the offshore installation (e.g. Tampnet), from which the signals may be communicated to the onshore receiver. Alternatively, the communications may be hardwired/wirelessly delivered through the offshore installation's network for transfer onshore via their internet connection. Communication between the one or more sensor devices and the receiver may be done autonomously, at specified intervals. The one or more sensor devices may be pre-set to send data at specified intervals or interim time. Alternatively, one or more signal may be sent to the one or more sensor devices to specify the interval or interim time for data communication, for example by a user. The data collected from the one or more sensor devices may be uploaded to a web page.

An advantage of some embodiments of the present invention is that the one or more sensor devices may allow for monitoring the local conditions of the system comprising the conductor and the guide, including the integrity and motions thereof, and/or for providing information on the effectiveness of the stabilising body.

The conductor is normally a substantially cylindrical pipe. The guide may comprise a substantially cylindrical main portion, an upper end and a lower end. The upper end is normally positioned proximally to the topside offshore installation and distally to the bottom of the sea, and the lower end is normally at the opposite end of the guide. The upper and lower ends may be defined as the cross-sections at the respective ends of the guide. The guide may comprise a conical portion, normally extending between the main portion and the upper end. The conical portion may be referred to as a funnel. The cross-sectional diameter of the conical portion normally increases along the length of the guide, towards the upper end. Consequently, the diameter of the upper end is normally larger than the average diameter of the main portion of the guide. The guide may optionally comprise a further conical portion between the main portion and the lower end.

The stabilising body may be shaped and sized to substantially fit in the annulus between the conductor and the guide. The shape and size of the stabilising body may be substantially the same as the shape and size of the annulus defined between the conductor and the guide. Optionally, at least one of the dimensions of the stabilising body may be reduced with respect to the corresponding dimension of the annulus.

Thus, the stabilising body may comprise a substantially cylindrical main portion, a first end, a second end. Normally, the first end of the stabilising body is positioned proximally to the topside offshore installation and distally to the bottom of the sea, and the second end is the opposite end thereof. The stabilising body further comprises a conical portion, normally extending between the main portion and the first end thereof. The cross-sectional diameter of the conical portion normally increases along the length of the stabilising body, towards the first end thereof. Consequently, the diameter of the first end of the stabilising body is normally larger than the average diameter of the main portion of the stabilising body.

An advantage of some embodiments of the present invention is that the substantially conical portion of the stabilising body may be configured to prevent the stabilising body from moving in the longitudinal direction towards the lower end of the guide and falling through the said guide.

The stabilising body normally defines a bore extending therethrough, along the length thereof. The bore of the stabilising body may be referred to as the main bore. The main bore of the stabilising body may be substantially cylindrical. The diameter of the main bore of the stabilising body may be the same as the diameter of the conductor, or it may be larger. Thus, there may be a space between the inner surface of the main bore of the stabilising body and the outer surface of the conductor.

The length of the stabilising body (measured along the longitudinal direction defined along the length of the conductor) may be as long as that of the guide. The length of the stabilising body may be greater than the length of the guide. Thus, the stabilising body may extend beyond the annulus defined between the conductor and the guide. The stabilising body may comprise at least one tail section that extends longitudinally beyond the annulus defined between the conductor and the guide. The at least one tail section of the stabilising body may be proximal to at least one of the ends thereof, preferably the second end. Thus, when the stabilising body is placed in the annulus between the conductor and the guide, there may be a tail section extending through the upper end and/or the lower end of the guide.

The tail section may comprise a radially extending section, that is a section with a diameter larger than that of the end of the guide proximal thereto, preferably that of the lower end of the guide. The radially extending section may be substantially cylindrical. The radially extending section may be shaped as a flange. The radially extending section may be substantially conical. The cross-sectional diameter of the radially extending section may decrease towards the second end of the stabilising body. The radially extending section may be wedge-shaped. The radially extending section may be referred to as a lip. Thus, when the stabilising body is placed in the annulus between the conductor and the guide, there may be a radially extending section, such as a lip or a flange, located outside of the guide, preferably below the lower end of the guide.

Advantageously, the radially extending section of the stabilising body may be configured to prevent the stabilising body from moving in the longitudinal direction towards the upper end of the guide and being dislodged from the guide through the upper end thereof.

The stabilising body may be pre-cast into a desired shape and size prior to being inserted into the annulus between the conductor and the guide. Thus, the stabilising body may be referred to as a pre-cast stabilising body.

Thus, according to a second aspect of the present invention there is provided a method of stabilising a conductor in a guide in an offshore system, wherein the conductor is run through the guide such that an annulus is defined between the outer surface of the conductor and the inner surface of the guide, with the length defined in the direction along the conductor; the method comprising the steps of:

providing a stabilising body pre-cast to substantially fill the annulus between the conductor and the guide, at least along part of the length thereof;

inserting the stabilising body into the annulus.

The pre-cast stabilising body may be used in a conductor guide located topside or subsea.

The pre-cast stabilising body may comprise any of the features described in relation to the stabilising body in the first aspect of the present invention.

The pre-cast stabilising body may be formed as a single piece, optionally composed of at least two parts. The number of parts of the pre-cast stabilising body may be adjusted for a particular offshore system. The pre-cast stabilising body may be composed of at least one pair of parts comprising a first part and a second part. The first part may be shaped and sized to be substantially the same as the second part. The second part may be arranged to fill substantially the same proportion of the annulus as the first part. Each part of the pre-cast stabilising body may itself be formed as a single piece.

The desired shape and size may be adjusted based on the results of physical tests, for example onshore tests. An onshore test may indicate whether the dimensions of the pre-cast stabilising body should deviate from the dimensions of the annulus between the conductor and the guide, and if so, an optimal deviation may be found. For example, the pre-cast stabilising body may be cast to define the main bore with a diameter larger than that of the conductor. This difference in size may depend on the expansion capability of the stabilising body due to water uptake, and it may be optimised through testing.

There may be a pre-existing centraliser present in the annulus between the conductor and the guide. The centraliser may be removed from the annulus prior to the insertion of the stabilising body therein. Optionally, the pre-cast stabilising body may be cast to fit around a pre-existing centraliser. Thus, advantageously, the centraliser may not be required to be removed from the annulus prior to insertion of the stabilising body, simplifying the method of stabilising the conductor in the guide.

Thus, the pre-cast stabilising body may expand when placed in water. Thus, one or more dimensions of the pre-cast stabilising body, when in use in a subsea system, may differ from the corresponding one or more dimensions to which the body is cast. The pre-cast stabilising body may be cast to have one or more dimensions smaller than when placed in water. For example, the pre-cast stabilising body may be cast to have the diameter of the main bore larger than the diameter of the conductor. Preferably the main bore of the stabilising body is large enough to provide at least sufficient space for expansion of the stabilising body when placed in water.

Thus, the step of providing a stabilising body pre-cast to substantially fill the annulus between the conductor and the guide, at least along part of the length thereof, may involve one or more of:

- determining the dimensions of the annulus;
- determining the expansion capability of the pre-cast stabilising body, or the one or more material components thereof, due to water intake;
- determining an optimal deviation between the dimensions of the stabilising body and the annulus to allow for expansion of the former when placed in the latter.

An advantage of some embodiments of the present invention is that the one or more reduced dimensions of the pre-cast stabilising body with respect to the annulus may allow for expansion of the stabilising body due to water uptake while providing enough space between the conductor and the expanded stabilising body to allow for the movement of the conductor in the longitudinal direction.

The pre-cast stabilising body may be deployed subsea by one or more of using an ROV, deploying a diver and using a remote topside tool such as a crawler system.

The stabilising body may be inserted into the annulus between the conductor and the conductor guide by means of one or more rods. The one or more rods may be metallic. The one or more rods may comprise or be made of the stabilising compound material. The one or more rods may be inserted into the stabilising body, preferably through the first end thereof, preferably one rod per part of the stabilising body. Once the stabilising body is in the desired place in the annulus, the rods may or may not be removed therefrom.

The stabilising body, or part thereof, may be resiliently deformable, that is may have shape memory. The shape and/or size of the stabilising body, or part thereof, especially the radially extending part thereof if present, may change during the insertion into the annulus. The stabilising body, or part thereof, especially the radially extending part thereof if present, may return to its initial shape when positioned in the desired place in the annulus.

An advantage of some embodiments of the present invention is that the substantially conical portion of the stabilising body and the radially extending part of the stabilising body may secure the stabilising body in the annulus between the conductor and the guide, thereby eliminating the need for a dedicated securing mechanism.

Optionally, the pre-cast stabilising body may define one or further bores, normally threaded bores. A threaded bore is a bore that is at least partially threaded.

The one or more further bores may be top bores, normally extending partway therethrough, to receive respective lifting bars. The one or more top bores may be through the first end of the stabilising body. The pre-cast stabilising body may further comprise one or more removable lifting bars, normally threaded bars, inserted therein, normally through the first end thereof. There may be one top bore and threaded bar per part of the stabilising body. The one or more threaded lifting bars may comprise a handle at an end thereof, such as a D handle, opposite to the end inserted into the stabilising body. The pre-cast stabilising body may be inserted into the annulus by means of the one or more removeable lifting bars.

The stabilising body may further define one or more side bores extending into the stabilising body in a direction substantially perpendicular to the longitudinal direction defined by the conductor, normally towards the main bore of the stabilising body. The side bores may be located within the substantially cylindrical main portion of the stabilising body, proximally to the second end thereof. The one or more side bores may be threaded bores, optionally sized to engage with the one or more lifting bars. The lifting bars, when engaged in the further bores may function as retaining bars. If the stabilising body comprises a plurality of threaded bars with different diameters, each of them may match the diameter of the side bore.

The pre-cast stabilising body may define one or more sockets therein, normally counter sunk into the side bores. The one or more sockets may extend partway through the stabilising body. The one or more sockets may extend between the surface of the main portion thereof and the main bore of the stabilising body, preferably partway therebetween. There may be one socket per part of the stabilising body. Normally, there is one further bore extending from each socket.

The one or more socket may be designed to receive a retainer block therein. The retainer block is preferably shaped and sized to substantially fit into the socket, whilst protruding out of the stabilising thus retaining the stabiliser below the frame in use. The retainer block normally defines a bore therein, which may or may not be a threaded bore, the diameter of which may be substantially the same or marginally larger than that of the threaded bore in the socket, and thus, that of the threaded bar. A single threaded bar is normally at least as long as the combined length of a single retainer block and a single side threaded bore in the stabilising body, extending from a single socket.

Thus, the stabilising body may comprise a retaining device. The retaining device may comprise the one or more threaded bars and/or the one or more retainer blocks.

Thus, the method of stabilising a conductor in a guide may further comprise the steps of:

- inserting a retainer block into a socket the stabilising body, the retainer block defining a bore therethrough, the stabilising body defining a side bore extending from the socket;

removing a removeable bar from the first end of the stabilising body, and inserting the said bar through the bore of the retainer block and into the side bore extending from the socket.

The method may further involve repeating the above steps if the stabilising body is composed out of more than one part, and/or if it comprises more than one socket and more than one bar.

If the one or more bars are threaded bars and the one or more side bores extending from the one or more sockets are threaded bores, the method may further involve a step of screwing the one or more threaded bars into the one or more threaded bores.

An advantage of some embodiments of the present invention is that the stabilising body may be easily installed and secured in place by means of the removeable bar.

The pre-cast stabilising body may comprise an inner body and an outer body. The inner body may comprise at least one part, preferably two or more parts. The outer body may comprise at least one part, preferably two or more parts.

The inner body may be substantially cylindrical and comprise a first end and a second end, both ends defined as outermost cross-sections thereof. Preferably, the inner body defines a bore extending therethrough between the first and the second ends thereof.

The outer body may comprise a substantially cylindrical main portion, a first end and a second end, both ends defined as outermost cross-sections thereof. The outer body may comprise a substantially conical portion extending between the main portion and the first end thereof. Normally, the cross-sectional diameter of the conical portion increases along the length of the conical portion, towards the first end. Normally, the diameter of the first end is larger than the average diameter of the main portion. Preferably, the outer body defines a bore extending therethrough between the first end and the second end. The bore of the outer body may comprise a substantially cylindrical portion and an inverted conical portion. The inverted conical portion may be proximal to the second end of the outer body. The inverted conical portion may form a lip around the inner surface of the bore of the outer body.

Preferably, the diameter of the cylindrical portion of the bore of the outer body is substantially the same as the diameter of the inner body. Preferably, the inner body substantially fits in the bore of the outer body.

The length (measured along the conductor) of the outer body may be greater than the length of the guide. Thus, outer body may extend beyond the annulus defined between the conductor and the guide. The outer body may comprise at least one tail section that extends beyond the annulus defined between the conductor and the guide. The at least one tail section of the outer body may be of substantial length. The at least one tail section of the outer body may be proximal to one of the ends thereof, preferably the second end.

The one or more tail section may comprise a radially extending section, that is a section with a diameter larger than that of the end of the guide proximal thereto, preferably that of the lower end of the guide. The radially extending section may be substantially cylindrical. The radially extending section may be shaped as a flange. The radially extending section may be substantially conical. The diameter of the radially extending section may decrease towards the second end of the outer body. The radially extending section may be referred to as a lip.

The inner body may be cast out of a material comprising a first elastic material component. The outer body may be cast out of a material comprising a second elastic material component. The first and second elastic material components may be the same or different. Preferably, the first and second elastic material components comprise elastic polyurethane. The elastic polyurethane may be formed of a mixture comprising a polyol and an isocyanate or diisocyanate. The first elastic material component may comprise a different ratio of the polyol to the isocyanate (or diisocyanate) than the second elastic material component. Thus, the inner body may have different mechanical properties than the outer body. Preferably, the outer body is more elastic than the inner body.

The one or more sensor devices may be included in the inner and/or the outer body, preferably in the inner body.

The pre-cast stabilising body may be used in an offshore system wherein the conductor pipe comprises one or more thrust collars. The one or more thrust collars may be located on the portion of the conductor run through the conductor guide. If the conductor comprises more than one thrust collar, they are normally separated from one another along the length of the conductor (longitudinal direction). The thrust collars may comprise a first thrust collar and a second thrust collar.

An advantage of some embodiments of the present invention is that the stabilising body may be easily installed on conductors comprising thrust collars.

Thus, the method of stabilising a conductor in a conductor guide may be a method wherein the conductor comprises a first thrust collar and a second thrust collar, wherein the stabilising body comprises an inner body and an outer body, and wherein the step of inserting the stabilising body into the annulus includes the steps of:

inserting the inner body into the annulus; and inserting the outer body into the annulus.

The inner body may be placed proximally to the outer surface of conductor and it may be in mechanical contact with the outer surface of the conductor. The diameter of the bore of the inner body may be substantially the same, or marginally larger, than the diameter of the conductor.

The inner body may be provided between the first and second thrust collar. The diameter of the inner body may be substantially the same as the diameter of the first and/or second thrust collar. The length of the inner body (in the longitudinal direction) may be substantially the same as the distance between the first thrust collar and the second thrust collar. The inner body may substantially fit between the first thrust collar and the second thrust collar.

The outer body may be placed proximally to the inner surface of the guide and may be in mechanical contact with the inner surface of the guide. The diameter of the outer body may be substantially the same, or marginally smaller, than that of the main portion of the guide. The outer body may substantially fit in the annulus defined between the inner body and the guide.

The outer body, or part thereof may be referred to as having shape memory. The shape of the outer body, or part thereof, normally the radially extending portion thereof if present, may change during the insertion into the annulus. The outer, or part thereof, normally the radially extending portion thereof, if present, may return to its initial shape when positioned in the desired place in the annulus.

The stabilising body may be formed on site from a stabilising compound that may be poured/pumped into the annulus between the conductor and the guide. Thus, the stabilising body may be referred to as a stabilising body cast in situ.

Thus, according to a third aspect of the present invention, there is provided a method of stabilising a conductor in a guide in an offshore system, wherein the conductor is run through the guide such that an annulus is defined between the outer surface of the conductor and the inner surface of the guide, the guide comprising an upper end and a lower end, the lower end being positioned more proximally to the seabed than the upper end; the method comprising the steps of:

installing a mould onto the conductor proximally to the lower end of the guide;

introducing to the mould and at least a portion of the annulus between the conductor and the guide a stabilising compound in a liquid form;

allowing the stabilising compound to set and form a solid stabilising body.

An advantage of some embodiments of the present invention is that the stabilising body is formed in situ rather than pre-cast to size, thus its dimensions may be matched precisely with the dimensions of the annulus and scaled or adapted to fit the dimensions of any system.

The setting of the stabilising compound may comprise gelling of the stabilising compound, that may be characterised by a gelling time. The gelling time may be a time at early cross-linking stage of a polymer. The gelling time of a polymer may be the time after which a disruption to the gel state does no longer compromise the properties of the final polymer. The gelling time may be measured as a time at which the viscosity of the stabilising compound crosses over from liquid to solid state of matter.

The setting of the stabilising compound may further comprise curing of the stabilising compound, which may be characterised by a setting time. The curing time is normally longer than the gelling time. The curing time may be the time after which the viscosity of the stabilising compound remains substantially unchanged.

Preferably, the stabilising compound sets into an elastic solid.

The stabilising compound may be the stabilising compound of the first aspect of the present invention.

The mould may be formed of one or more parts, preferably two parts. The mould may thus be assembled around the outer surface of the conductor when the one or more parts, preferably two parts, are brought together. The one or more parts, preferably two parts, of the mould may be held together by a fastening mechanism, which may be a ratchet strap.

The mould may have a substantially circular base and a substantially cylindrical wall. The diameter of the base of the mould may be similar to, optionally larger than, that of the substantially cylindrical main portion of the guide. The length of the wall of the mould may be substantially smaller than that of the guide. Thus, the wall of the mould may overlap with part of the main portion of the guide, on the outside of the guide. Thus, the mould may be referred to as an outer mould.

Optionally, the diameter of the base may be smaller than that of the main portion of the guide. Thus, the wall of the mould may overlap with part of the main portion of the guide on the inside of the guide. Thus, the mould may be referred to as an inner mould. The length of the wall of the inner mould may be substantially the same, preferably larger than, that of the guide. The wall of the inner mould may extend through the guide, beyond the upper end and/or lower end thereof. The construction of the first mould may require the placement of one or more additional moulds at the lower end of the guide which prevent the escape of the liquid form stabilising compound in the subsequent process. The one or more additional moulds normally have an inner diameter largely equal to that of the conductor and an outer diameter at least equal to that of the first mould.

Normally, a demoulding agent is applied to the mould before introducing the stabilising compound thereto. Normally, the demoulding agent does not react with the stabilising agent in the normal onsite conditions and timescales of the system lifetime. A lubricant may be applied to the mould. Optionally the demoulding agent may have lubricating properties. The demoulding agent may be water-based or, silicon-based or a solvent.

Normally, the conductor is stabilised in the guide by means of a centraliser, prior to carrying out the method. The centraliser may be worn or otherwise damaged. The method may include a step of removing the centraliser from the annulus between the conductor and the guide. The centraliser may be removed after the stabilising compound, preferably the first amount thereof, sets to form the stabilising body. Optionally, the centraliser may not be removed, but left to remain in the annulus between the conductor and the guide.

The method may further include the step of applying a demoulding agent onto part of the outer surface of the conductor and/or part of the inner surface of the guide, before introducing the first amount of the stabilising compound into the portion of the annulus. Preferably, the demoulding agent is applied to a part of the conductor proximally to the lower end of the guide and/or the bottom part of the guide. The demoulding agent may be applied to the outer surface of the conductor especially if the centraliser is removed. The demoulding agent may be applied onto the inner surface of the guide especially if the centraliser is left to remain in the annulus.

The method may further include applying the demoulding agent onto a further part of the outer surface of the conductor and/or the inner surface of the guide, normally immediately above the stabilising body and, preferably, to a level below that of the upper end to the guide.

The stabilising compound may be referred to as the first stabilising compound and the method may further include the step of introducing a second stabilising compound into the annulus, preferably, after the first stabilising compound gels and, normally, before it fully cures. The method may further include the step of allowing the second stabilising compound to set, adding to the volume of the stabilising body. The method may further include the step of introducing the one or more sensor devices into the annulus, normally before the second amount of stabilising compound sets, normally before it gels.

The method may further include applying the demoulding agent onto a yet further part of the outer surface of the conductor and/or the inner surface of the guide, normally immediately above the stabilising body and, preferably, at least up to the upper end of the guide. The method may further include the step of introducing a third stabilising compound into the annulus, preferably after the second stabilising compound gels and, normally, before it fully cures. The method may further include the step of allowing the third stabilising compound to set, further adding to the volume of the stabilising body.

The method may involve further steps involving adding further stabilising compounds into the annulus, in a similar manner as described above.

The first, second and third stabilising compounds (and any further stabilising compounds) may or may not be the same.

The stabilising body, preferably in its fully cast form, may be the stabilising body described in the first aspect of the present invention.

The method may further include un-installing the mould after the stabilising compound sets to form the stabilising body, preferably after the compound gels and before it fully cures. The mould, especially if it is an outer mould, may be removed after the first stabilising compound sets to form the stabilising body, or optionally, after the second stabilising compound sets and ads to the volume of the stabilising body, or further optionally, after the third stabilising compound sets and adds into the volume of the stabilising body.

Optionally, chocks or rigging may be used to temporary hold the conductor stable until casting of the stabilising body is complete. The chocks may form part of the stabilising body once the casting process is complete. The chocks may be made of a stabilising compound such as the first, second, third or any further stabilising compounds described herein.

The stabilising body may be referred to as inner stabilising body, preferably if cast using the inner mould. The inner stabilising body may be cast without applying the demoulding agent onto the outer surface of the conductor. Thus, the inner stabilising body may be bonded onto the surface of the conductor. The inner stabilising body may be cast in a single step of filling the inner mould with the stabilising compound and allowing it to set. The mould may be referred to as the first mould and may or may not be removed and the method may further involve the step of installing a second mould onto the conductor, preferably an outer mould. There may be a remaining part of the annulus defined between the inner surface of the guide and the inner body. The method may further involve the step of filling the outer mould and the remaining part of the annulus with a further stabilising compound. The method may further involve allowing the further stabilising compound to set and form an outer stabilising body. The second stabilising body may be formed without applying demoulding agent onto the inner surface of the guide. Thus, the outer stabilising body may be bonded onto the said surface of the guide. The first mould may be removed, once the inner and outer stabilising bodies are set, leaving a substantially vertical circumferential gap between said stabilising bodies, normally along the full height of the outer body. In use, the gap between the stabilising bodies may allow for vertical movement of the conductor relative to the guide during operation, remediation and decommissioning activities. In combination, the inner and outer stabilising bodies provide an additive effect with regards to reduction of wave induced impact on the system, vibration or other undesirable environmental or production effects.

Preferably, the inner stabilising body comprises a cylindrical portion with length at least 50% of the length of the guide (the length defined in the direction along the conductor), optionally the full length of the guide. The outer stabilising body may comprise a cylindrical portion and at least one radially extending portions having an outer diameter greater than the main cylindrical portion. Preferably the outer stabilising body extends along the full length of the guide and is contained within it, at least at the lower end. However, the inner and/or outer stabilising body may be longer than and thus extending beyond the guide (for example, by at least 200 mm), either at one end or, optionally, at both ends thereof. The inner and outer stabilising body may be arranged eccentrically or concentrically with respect to one another. The at least one sensor devices may be cast in the inner stabilising body and/or the outer stabilising body, preferably in the inner stabilising body.

An advantage of some embodiments of the present invention is that the inner and outer stabilising bodies may be bonded to the surfaces of the conductor and guide, respectively, thereby forming an environmental seal (e.g. against water and air) meaning that the risk of crevice corrosion thereon may be eliminated.

The outer surface of the inner body and the inner surface of the outer body may be in contact with one another. There may be a space between the outer surface of the inner body and the inner surface of the outer body. The space may be the circumferential gap defined above. Thus, the outer diameter of the inner stabilising body may be smaller than the inner diameter of the outer stabilising body. At least one of the inner and outer bodies may fill less than 50% of the cross-section of the annulus defined by the conductor and the guide. The gap between the inner and outer stabilising bodies is normally selected to take account of the changing dimensions of said stabilising bodies during the life of the centraliser. Such changes in dimension may be a result of water uptake, compression set, abrasion etc. which may result from service conditions (environmental and/or process). Thus, optimal conditions for a pre-selected duration of the centraliser's lifespan may be provided. In preferred embodiments, the inner and outer stabilising bodies may have one or more of the following mechanical properties (upon installation): hardness in the range of 45-96 on the Shore A scale; tensile strength of 8-28 $N/mm^2$; elongation at break of 270-570%; tear propagation resistance of 9-68 $N/mm^{\wedge 2}$. The specific values for the inner and outer body may not be the same.

An advantage of some embodiments of the present invention is that the inner and outer stabilising bodies may not be bonded to one another. Thus, the only moving surfaces in contact may be the outer surface of the inner body and the inner surface of the outer body and, thus, abrasion of the surface of the conductor and/or guide due to their relative motion may be eliminated, or at least substantially reduced.

The further stabilising compound may or may not be the same as the first, optionally second and optionally third stabilising compound. For example, each compound may comprise elastic polyurethane, normally formed of a mixture comprising a polyol or a blend of more than one polyols and an isocyanate or diisocyanate, but the ratio of the polyol to the isocyanate (or diisocyanate) in the different mixtures may not be the same. Thus, the outer stabilising body may or may not have one or more different mechanical properties than the inner stabilising body. The mechanical properties of the one or more material components may include one or more of hardness, elongation at break, tensile strength, compressive strength, compression set, elastic modulus, abrasion resistance, water uptake and/or fatigue life. The mixing of the components may be done via manual or mechanical means, either prior to the components reaching the worksite or on the worksite itself.

The outer diameter of the inner stabilising body may be equal, or preferably greater than the outer diameter of any appurtenances on the conductor such as connectors or thrust collars, along its length so as not to impact subsequent remediation/decommissioning of the conductor. The inner diameter of the outer stabilising body is normally larger than the outer diameter of the inner stabilising body once it has accounted for conductor appurtenance. The inner and outer stabilising bodies are preferably shaped so as to allow the passage of a fixed or adjustable blade centraliser (inclusive of thrust collars) further down the conductor during remediation/decommissioning work. The inner stabilising body may be shaped largely similarly to the fixed or adjustable blade centraliser (including thrust collars), and the outer stabilising body may be cast into the remaining annular space against the inner surface of the guide. In use, when removing the conductor, the void left by the removed inner stabilising body within the guide may allow the existing centralisers to pass through the guide. In systems with a pre-existing centraliser, such as a steel centraliser, where the centraliser is not to be removed prior to the installation of some embodiments of this invention (for example due to due to commercial, technical or operational reasons) the stabilising body may be cast around the existing centraliser. Thus, the inner stabilising body may be cast around the existing centraliser either fully or partially encapsulating it. The outside profile (or shape) of the inner stabilising body may be substantially similar to that of the existing centraliser (albeit dimensionally larger) but, more preferably, it may be largely cylindrical in shape. The shape and dimensions of the inside profile (bore) of the outer stabilising body are normally similar to the outside profile of the inner stabilising body.

The method of stabilising a conductor in a conductor guide according to any one of the aspects of the present invention may further be a method of monitoring the integrity and/or motion of the system comprising the conductor and the guide, and/or individual part thereof. Post completion of the casting of the inner and outer stabilising body, the bond with the conductor and guide, respectively, may be assessed using one or more measurements taken circumferentially and/or longitudinally using, for example, an ultrasonic inspection technique such as Pulse Echo. Whether the inner stabilising body is bonded with the conductor may be assessed based on whether a reflection is obtained or not from outer and/or inner surfaces of the conductor. If there is no reflection, this is indicative that there is a good bond between the guide frame and the outer body.

Whether the outer stabilising body is bonded with the guide may be assessed based on whether a reflection is obtained or not from the inner surface of the guide. If the inner body is well bonded, then the wall of the conductor will typically be observed through a reflection.

Furthermore, post completion of the casting of the inner stabilising body, the bond with the conductor may be assessed using one or more measurements taken circumferentially at the top and/or bottom of the body using, for example, an ultrasonic inspection technique such as Shear Wave. This technique may be used to assess environmental ingress between the inner stabilising body and the conductor.

Thus, the method may further involve one or more of:

- using the at least one sensor devices for obtaining data, including one or more parameters related to the integrity of the system comprising the conductor and the guide and/or the motion thereof;
- sending one or more signals to the at least one sensor devices to activate data transmission and/or establish time intervals for data transmission;
- transmitting the data or part thereof to a one or more receivers located either on an offshore installation or onshore;
- uploading the data to a designated website.

The signal and/or data transmission between the at least one sensor devices and the one or more receivers may be done wirelessly.

The stabilising body may be used over a repair solution. The repair solution may involve repairing the conductor, for example, following a breach therein.

The method of stabilising a conductor in a guide and monitoring the integrity thereof may be retrofitted to exiting conductors or installed on new conductor guide systems.

It will be understood that features described in relation to any of the above aspects can be combined with any of the other aspects described herein apart from those with which such features would be self-evidently incompatible. Optionally any of the stabilising bodies described herein may be cast with removable polymer sections which, in use, may be removed and tested to confirm the material properties and assess the polymers degradation due to exposure to the environmental and service conditions.

Modifications and improvements can be incorporated without departing from the scope of the invention.

BRIEF DESCRIPTION OF THE DRAWINGS

Embodiments of the invention are further described hereinafter with reference to the accompanying drawings, in which.

DETAILED DESCRIPTION

Figure 1A:
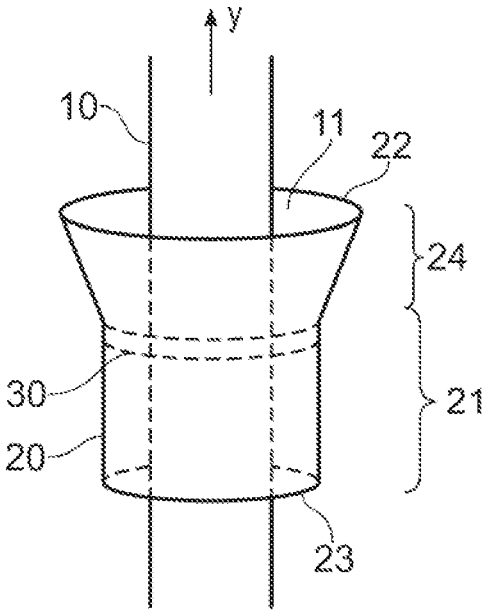
FIG. 1a (Prior Art)
FIG. 1*a* shows a side view of a prior art arrangement of a conductor pipe in a conductor guide.

FIG. 1*a* shows a typical set up of a conductor pipe 10 run through a conductor guide 20. The conductor pipe 10 defines a longitudinal dimension along the length thereof, denoted as the y-axis. As follows, references to the length of the conductor pipe 10 or the length of the conductor guide 20 should be understood as substantially along the direction defined by the y-axis.

Figure 1B:
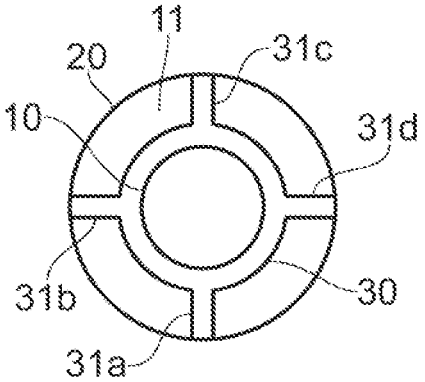
FIG. 1b (Prior Art)
FIG. 1*b* shows a top view of the prior art arrangement of FIG. 1.

The conductor guide 20 comprises a substantially cylindrical main portion 21 whose diameter is substantially constant along the length thereof. The guide 20 further comprises an upper end 22 and a lower end 23. The upper end 22 and lower end 23 are defined as the cross-sections at the respective ends of the guide 20. The guide 20 further comprises a substantially conical portion 24 extending between the main portion 21 and the upper end 22. The cross-sectional diameter of the conical portion 24 increases along the length of the guide 20, towards the upper end 22. Consequently, the diameter of the upper end 22 is larger than the average diameter of the main portion 21. The dashed line shows the central position of a centraliser 30 in the annulus 11 defined between the conductor 10 and the guide 20. FIG. 1*b* is a top down view of the set-up of FIG. 1*a*. The centraliser 30 comprises four contact elements 31*a*-31*d* which are welded/bolted to the guide 20. In FIG. 1*b*, the centraliser is operational and thus stabilises the conductor 10 in the guide 20.

Figure 1C:
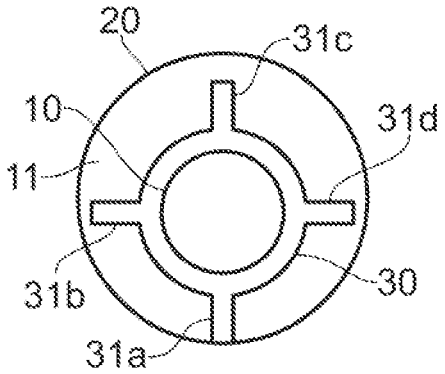
FIG. 1c (Prior Art)
FIG. 1*c* shows a top view of the prior art arrangement of FIG. 1 wherein a fault has occurred.

Over time, fatigue of the guide due to cyclical loading of waves and currents may lead to failure of the welding/bolting of one or more of the contact elements 31*a*-31*d*. FIG. 1*c* is another top view of the set up in FIG. 1*a*, but in which case a failure of welding/bolting of the contact elements 31*b*-31*d* has occurred and the stability of the conductor 10 within the guide 20 is compromised.

Figure 2:
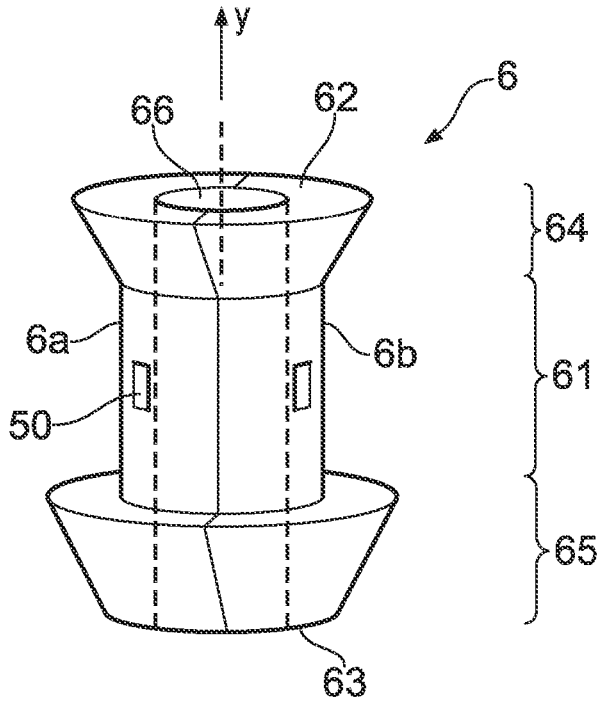
FIG. 2 shows a side perspective view of an embodiment of the present invention.
Figures 3A, 3B, 3C:
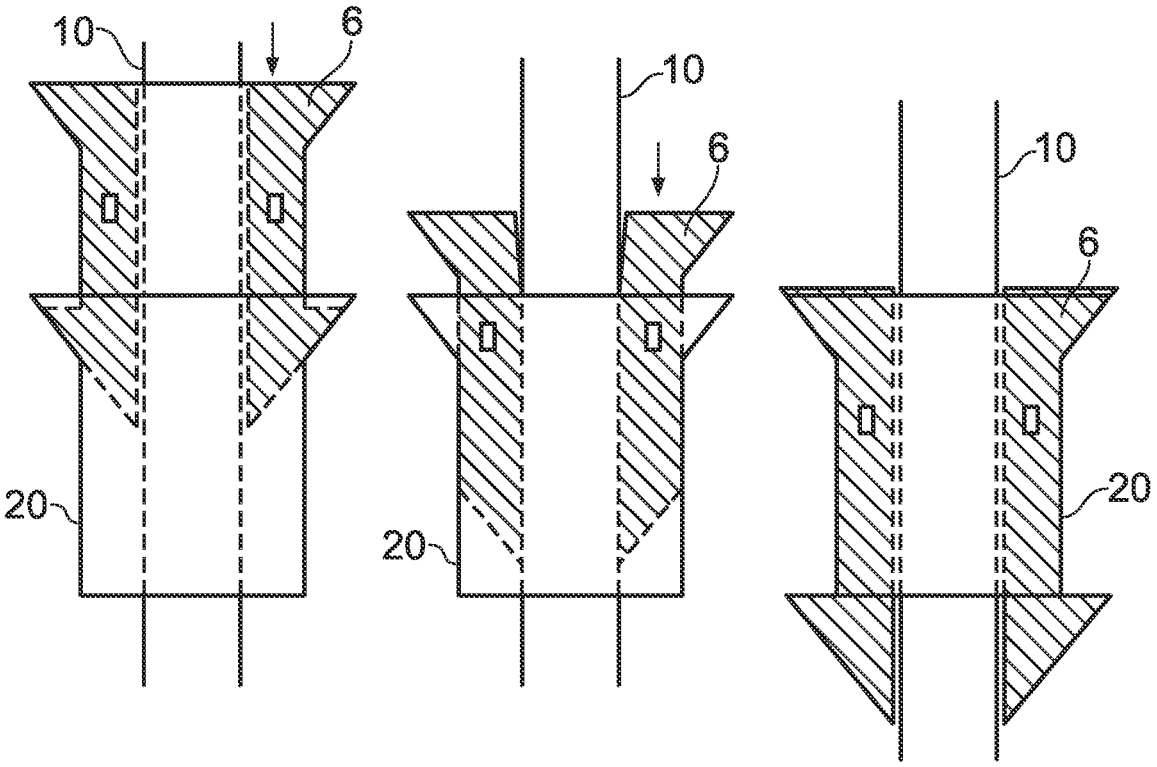
FIGS. 3*a*-3*c* are sequential side sectional views of the FIG. 2 apparatus.

An embodiment of an apparatus and method of stabilising a conductor 10 in a guide 20, for example following a centraliser failure, according to the present invention, is shown in FIGS. 2-3*c*.

The size of the annulus 11 in FIG. 1*a* can be determined and a stabilising body of desired dimensions may be pre-cast to substantially fit the annulus 11. FIG. 2 shows an elastic polyurethane stabilising body 6 pre-cast in two parts 6*a*, 6*b*. The stabilising body comprises sensor devices 50 within the main portion 61 thereof. The sensor devices 50 are comprise an EMAT sensor and an accelerometer.

The stabilising body 6 comprises a substantially cylindrical main portion 61 whose diameter is substantially constant along the length of the stabilising body 6. The stabilising body 6 further comprises a first end 62 and a second end 63, both ends defined as outermost cross-sections of the stabilising body 6. The stabilising body 6 further comprises a conical portion 64 extending between the main portion 61 and the first end 62. The diameter of the conical portion 64 increases along the length of the conical portion 64, towards the first end 62. Consequently, the diameter of the first end 62 is larger than the average diameter of the main portion 61. The stabilising body further comprises an inverted conical portion 65 extending between the main portion 61 and the second end 63. The diameter of the inverted conical portion 65 proximal to the main portion 61 is substantially larger than the main diameter of the main portion 61, and decreases along the length of the inverted conical portion 65, towards the second end 63. Thus, the inverted conical portion 65 forms an arrowlike shape pointing towards the second end 63. Finally, the stabilising body 6 comprises an annulus 66 extending through the length thereof, from the first end 62 to the second end 63.

The dimensions of the stabilising body 6 are substantially matched to the dimensions of the system in which it is used, such as that shown in FIG. 1*a*. The diameter of the main portion 61 and conical portion 64 of the stabilising body 6 substantially matches the diameter of the main portion 21 and the conical portion 24 of the guide 20. The diameter of the annulus 66 of the stabilising body 6 is marginally larger than the diameter of the conductor 10. Thus, the stabilising body 6 substantially fits in the annulus 11 between the conductor 10 and the guide 20. The maximum diameter of the inverted conical section is larger than the diameter of the lower end 23 of the guide 20, such as to secure the stabilising body 6 in the annulus 11.

FIGS. 3*a*-3*c* show the stabilising body in use in the set-up of FIG. 1*a*, located subsea. As shown in FIG. 3*a*, the two parts 6*a*, 6*b* meet around the conductor pipe to form the stabilising body 6 and pushed into the annulus 11. While being pushed through the annulus 11, the elastic inverted conical section 65 is deformed, thereby allowing for the stabilising body 6 to be pushed further through the annulus, as shown in FIG. 3*b*. The inverted conical section 65 returns substantially to its original shape as it emerges beyond the lower end 23, securing the stabilising body 6 in place, as depicted in FIG. 3*c*.

An advantage of some embodiments of the present invention is that the stabilising body 6 is pre-cast prior to use, thus being suitable for use in both topside and subsea locations.

A further advantage of some embodiments of the present invention is that the elasticity and relatively light weight of the stabilising body 6 allow for an easy and safe installation thereof.

A further advantage of some embodiments of the present invention is that the stabilising body 6 is in form of a stress-absorbing elastic solid and substantially fills the annulus between the conductor 10 and the guide 20. Thus, stabilising body 6 allows for making use of the full stabilising capability of the guide 20, while avoiding point-stress loads and dampening vibration, A further advantage of some embodiments of the present invention is that the stabilising body 6 is not bonded to the surface of the conductor 10, thereby allowing for vertical movement of the conductor 10 within the guide 20.

A further advantage of some embodiments of the present invention is that the durability of the elastic polyurethane and its resistance to corrosion eliminates the need of maintenance of the stabilising body 3 after installation.

A further advantage of some embodiments of the present invention is that the substantially conical portion of the stabilising body 3 prevents the stabilising body 3 from moving down the guide 20, while the flange-shaped radially extending portion below thereof prevents it from moving up the guide 20. Thus, the stabilising body 3 secures itself in the guide 20, eliminating the need for a dedicated securing mechanism.

A further advantage of some embodiments of the present invention is that the sensor devices 50*a*, 50*b* provided as part of the stabilising body 6 allow for monitoring local conditions of the conductor 10 and/or the guide 20.

A further embodiment of an apparatus and method of stabilising the conductor 10 in the guide 20, according to the present invention, is shown in FIGS. 4*a*-5*c*.

Figure 4A:
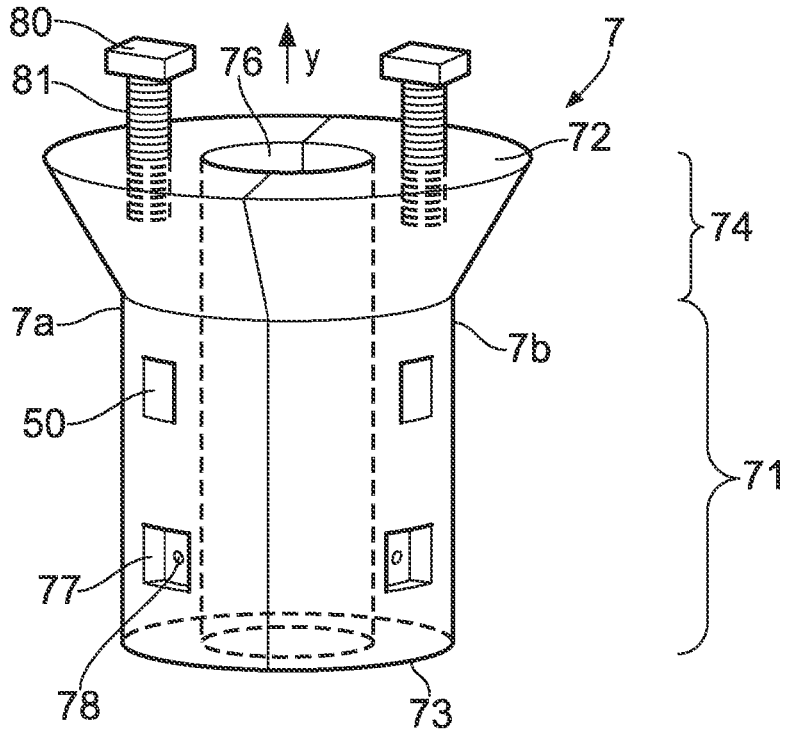
FIGS. 4*a*-4*b* show a side perspective view of an embodiment of the present invention.

FIG. 4*a* shows a stabilising body 7 pre-cast in two parts 7*a*, 7*b* from a stabilising compound 2. The stabilising body comprises sensor devices 50 within the main portion 61 thereof. The sensor devices 50 comprise an EMAT sensor and an accelerometer.

The stabilising body 7 comprises a substantially cylindrical main portion 71, a first end 72 and a second end 73, both ends defined as outermost cross-sections of the stabilising body 7. The stabilising body 7 further comprises a conical portion 74 extending between the main portion 71 and the first end 72. The diameter of the conical portion 74 increases along the length of the conical portion 74, towards the first end 72. Consequently, the diameter of the first end 72 is larger than the average diameter of the main portion 71.

The stabilising body 7 further comprises two removable threaded bars 81 inserted thereto through the first end 72 thereof, one into each part 7*a*, 7*b* thereof. Each threaded bar 81 comprises a handle 80 at an end thereof, opposite to the end inserted into the stabilising body 7. The stabilising body 7 further defines two sockets 77, one in each part 7*a*, 7*b* thereof. Each socket 77 is located within the main portion 71, proximally to the second end 73. Each socket 77 defines a threaded bore 78, dimensions of which match that of the threaded bar 81.

Figure 4B:
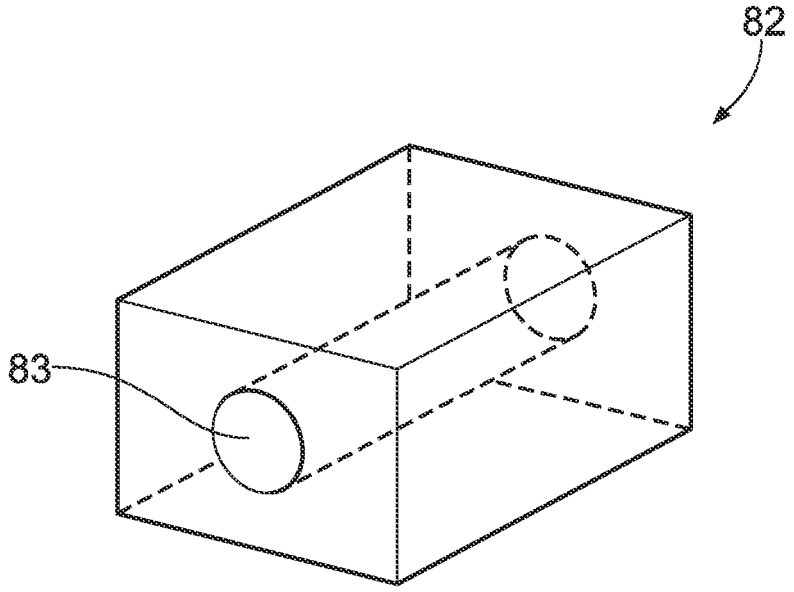

A retainer block 82 is shown in FIG. 4*b* with dimensions matching the dimensions of the socket 77. The retainer block 82 defines a threaded bore 83 extending through two opposite ends thereof. The dimensions of the threaded bore 83 match the dimensions of the threaded bore 78 and the threaded bar 81.

Figure 5A:
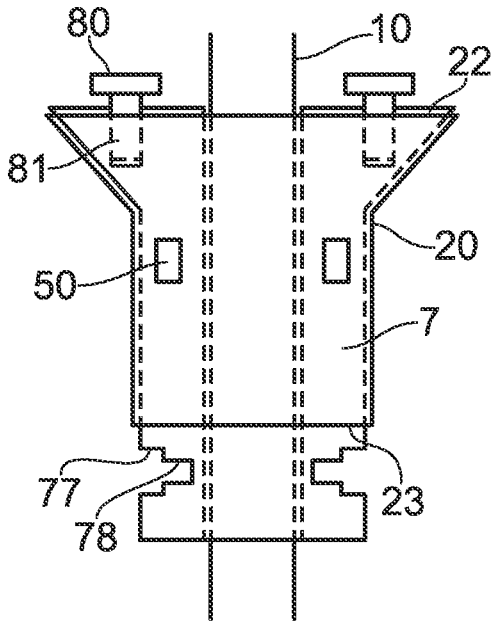
FIGS. 5*a*-5*c* are sequential side sectional views of the FIG. 4*a*-4*b* apparatus.
Figure 5B:
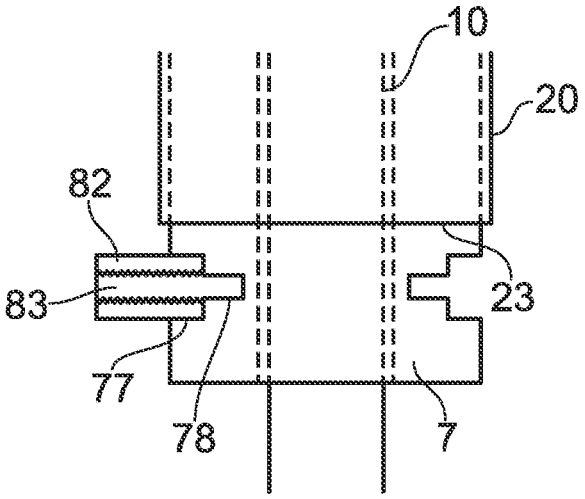
Figure 5C:
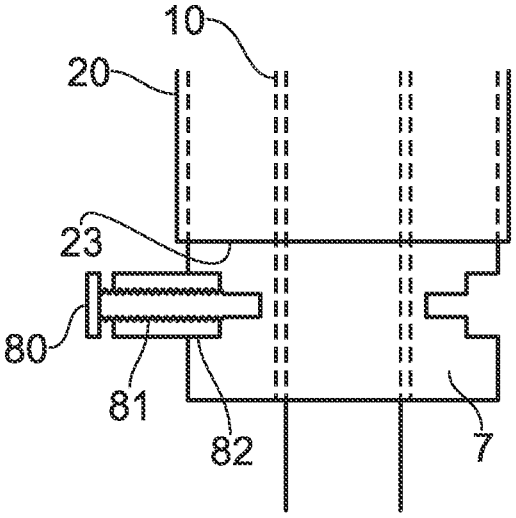

FIGS. 5*a*-5*c* show the stabilising body in use in the set-up of FIG. 1*a*.

As shown in FIG. 5*a*, the two parts 7*a*, 7*b* meet around the conductor 10 to form the stabilising body 7 and are inserted into the annulus 11 between the conductor 10 and the guide 20, using the handles 80. The dimensions of the stabilising body 7 are substantially matched to the dimensions of the annulus 11. The diameter of the main portion 71 and conical portion 74 of the stabilising body 7 substantially matches the diameter of the main portion 21 and the conical portion 24 of the guide 20. The diameter of the annulus 76 of the stabilising body 7 is marginally larger than the diameter of the conductor 10. Thus, the stabilising body 7 substantially fits in the annulus 11 between the conductor 10 and the guide 20. The main portion 71 of the stabilising body 7 is longer than the main portion 21 of the guide 20. Thus, a portion of the stabilising body 7 proximal to the second end 73 thereof extends through and beyond the lower end 23 of the guide 23. The portion of the stabilising body 7 extending beyond the lower end 23 defines the sockets 77.

As shown in FIG. 5*b*, once inserted into the annulus 11, the stabilising body is secured in place by means of the retainer blocks 82, which are inserted into the sockets 77. The bore 83 of each retaining block 77 aligns with the respective bore 78 in the stabilising body 7. The handles 80 are then used to remove the respective rods 81 from the first end 72 of the stabilising body 7 and insert them into the respective threaded bores 83, through the retaining blocks 82, and into the threaded bores 78. Thus, the threaded bars 81 holding the retainer blocks 82 in the sockets 77 prevent movement of the stabilising body 7 through the guide 20 in the directions towards the upper end 22, thereby securing the stabilising body 7 in the annulus 11.

An advantage of some embodiments of the present invention is that the stabilising body 7 may be easily installed and secured in place by means of the threaded bars 81.

Figure 6A:
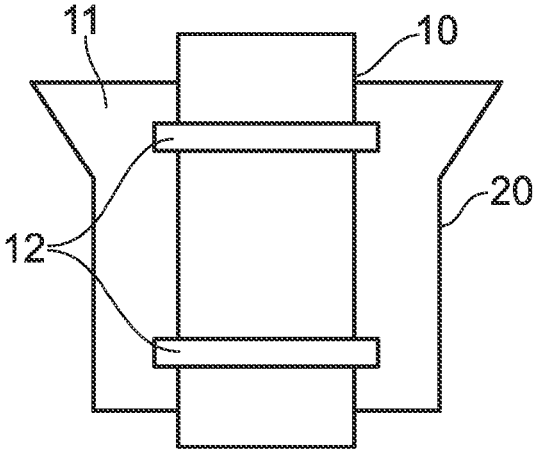
FIG. 6*a* shows a side view of a prior art arrangement of a conductor pipe comprising thrust collars in a conductor guide.

A further embodiment of an apparatus and method for stabilising the conductor 10 in the guide 20, according to the present invention, is shown in FIGS. 6*a*-6*d*. In this example, the offshore system is that shown in FIG. 1*a*, but additionally comprising thrust collars 12 on the conductor 10, as depicted in FIG. 6*a*.

Figure 6C:
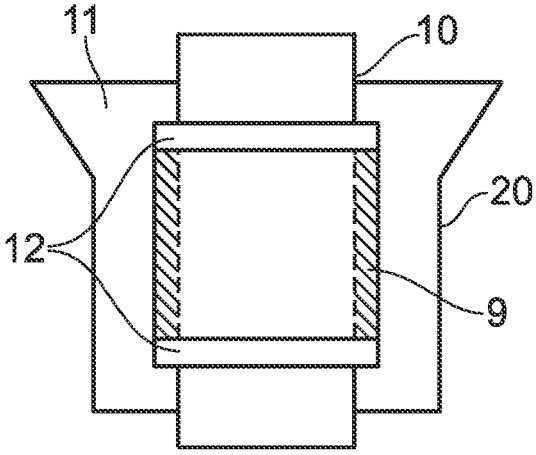
FIGS. 6*c*-6*d* are sequential side sectional views of the FIG. 6*b* apparatus.
Figure 6D:
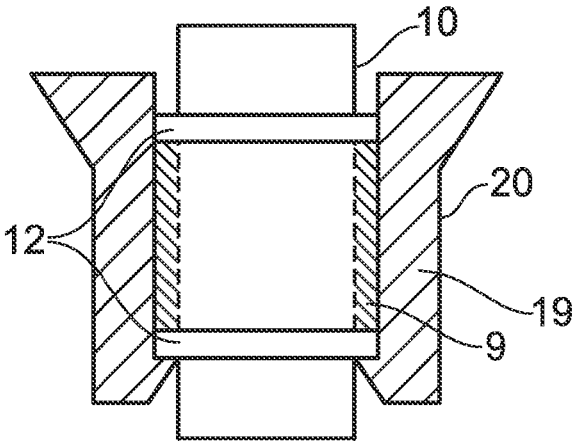
Figure 6B:
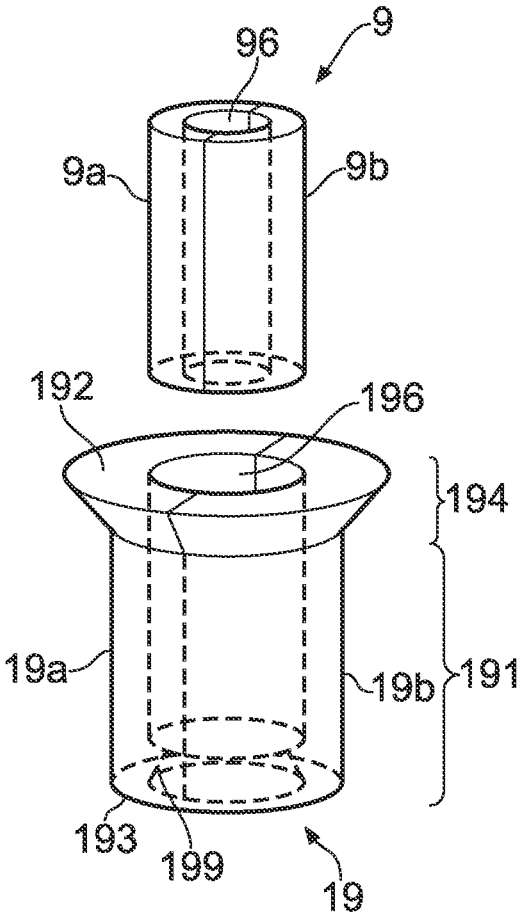
FIG. 6*b* shows a side perspective view of an embodiment of the present invention.

FIG. 6*b* shows a stabilising body comprising an inner body 9, formed in two parts 9*a*, 9*b* out of a stabilising compound 2*a*, and an outer body 19 formed in two parts 19*a*, 19*b* out of a stabilising compound 2*b*. The outer body 19 can be characterised by a larger degree of elasticity compared with the inner body 9. Alternatively, the inner and outer bodies 9, 19 may be cast of the same material, thereby having the same degree of elasticity.

The inner body 9 is substantially cylindrical and defines a bore 96 extending therethrough.

The outer body 19 comprises a substantially cylindrical main portion 191, a first end 192 and a second end 193, both ends defined as outermost cross-sections of the outer body 19. The outer body 19 further comprises a substantially conical portion 194 extending between the main portion 191 and the first end 192. The diameter of the conical portion 194 increases along the length of the conical portion 194, towards the first end 192. Consequently, the diameter of the first end 192 is larger than the average diameter of the main portion 191. The outer body 19 defines a bore 196 extending therethrough between the first end 192 and the second end 193. The bore 196 comprises a substantially cylindrical portion and an inverted conical portion, the latter forming a lip 199 around the inner surface of the bore 196, proximal to the second end 193. The lip 199 is directed radially inwardly towards the conductor 10.

The diameter of the cylindrical portion of the bore 196 is substantially the same as the diameter of the inner body 9. Thus, the inner body 9 substantially fits in the bore 196 of the outer body 196.

In FIG. 6*c*, parts 9*a*, 9*b* are inserted into the annulus 11, between the thrust collars 12, to form the inner stabilising body 9. The diameter of the inner stabilising body 9 substantially matches the diameter of the thrust collars 12, and the inner annulus of the stabilising body 9 is marginally larger than that of the conductor 10.

The parts 10*a*, 10*b* are then inserted into the annulus 11, forming the outer stabilising body 19, as shown in FIG. 6*c*. The elasticity of the outer stabilising body 19 allows for the lip 199 to deform thereby allowing for insertion of the outer body 19 into the annulus 11. Once the outer body 19 is in place, the lip 199 returns substantially to its initial shape, locking the outer body 19 against the thrust collar 12 proximal to the lower end 23 of the guide 20. Thus, the lip 199 secures the outer body 19 in the annulus 11, with the inner body 9 therein, as shown in FIG. 6*d*.

An advantage of some embodiments of the present invention is that the stabilising body 9 may be easily installed on conductors comprising thrust collars 12.

A further embodiment of an apparatus and method for stabilising the conductor 10 in the guide 20, particularly suited to a topside arrangement (above the surface of the sea), according to the present invention, is shown in FIGS. 7*a*-8*h*.

Figure 7A:
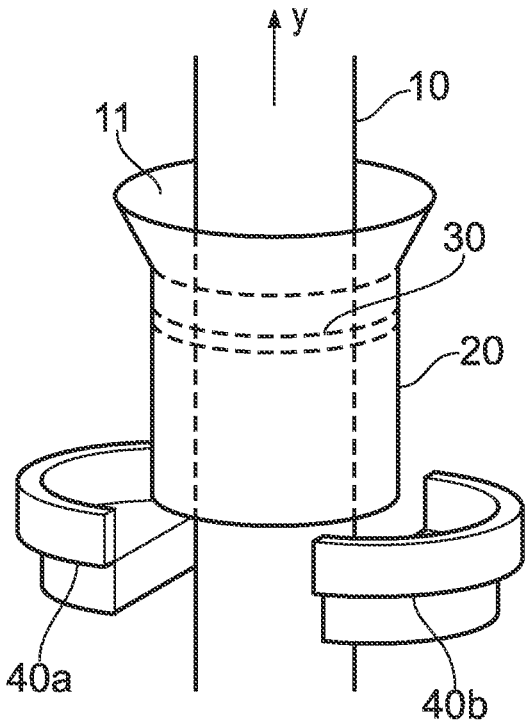
FIGS. 7*a*-7*b* show a perspective side sectional views of an embodiment of the present invention.
Figure 7B:
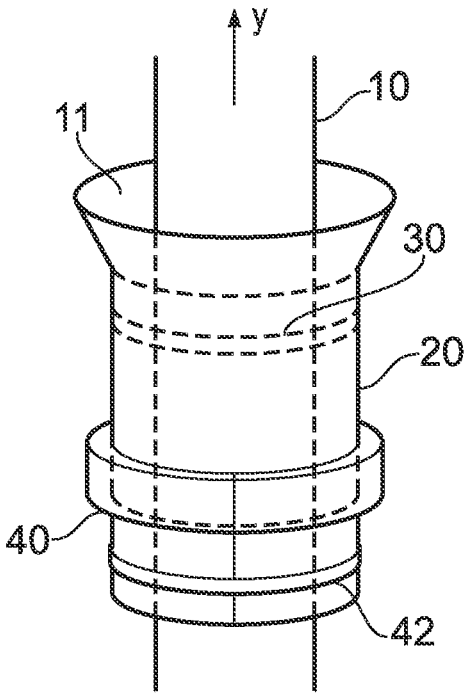

FIGS. 7*a* and 7*b* show the set-up of FIG. 1*a* also comprising two semi-moulds 40*a*, 40*b*. The semi-moulds 40*a*, 40*b* can be assembled into a single mould 40 around the conductor 10 near the lower end 23 of the guide 20 as depicted in FIG. 1*e*. The mould 40 can be installed onto the conductor 10 via rope access and held in place by a retaining member 42 in the form of a rachet mechanism 42.

Figure 8A:
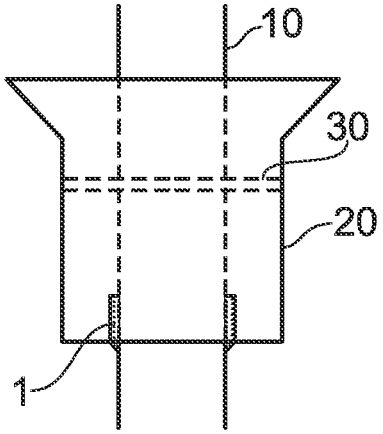
FIGS. 8*a*-8*h* are sequential side sectional views of the FIG. 7*a*-7*b* apparatus.
Figure 8B:
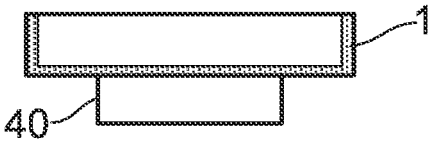
Figure 8C:
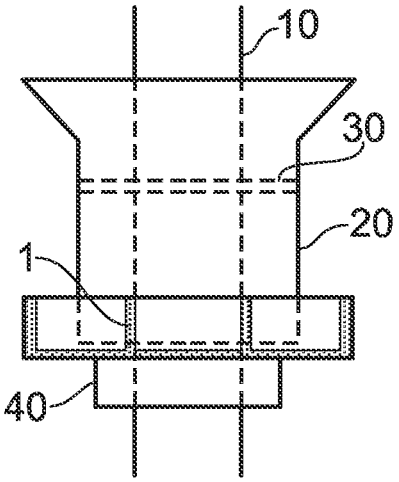

As shown in FIG. 8*a*, part of the conductor 10, below the centraliser 30, is painted with a demoulding agent 1. The demoulding agent 1 is provided to ensure that the surface of the conductor 10 is prevented from bonding to the surface of a stabilising body later cast in the annulus 11. The demoulding agent 1 is similarly applied to the inner surface of the mould 40, as shown in FIG. 8*b*. The semi-moulds 40*a*, 40*b* are formed into a single mould 40 around the conductor 10 near the lower end 23 of the guide 20 as depicted in FIG. 8*c*.

Figure 8D:
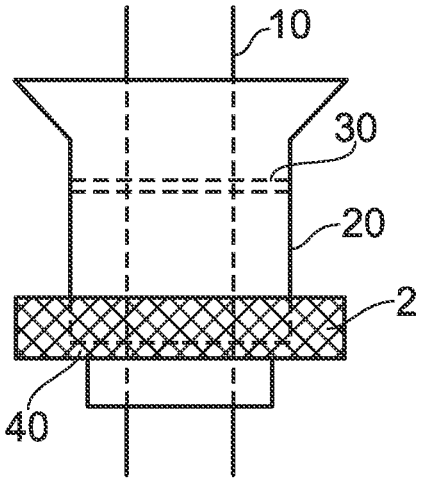

A stabilising compound 2, such as an elastic polyurethane, initially in a flowable state, such as a liquid state, is then poured into the mould 40 in a quantity sufficient to fill the mould 40, for example to fill a portion of the guide 20 up to a level below the centraliser 30, as shown in FIG. 8*d*. Subsequently, the stabilising compound 2 sets into an elastic solid which forms the bottom section of a stabilising body 3.

For example, based on a temperature of 20 degrees centigrade, the stabilising compound 2 will gel after one hour and be fully cured after 24 hours. Once the stabilising compound gels, and before it fully cures, the centraliser 30 is removed from the annulus 11 and the mould 40 may be removed.

Figure 8E:
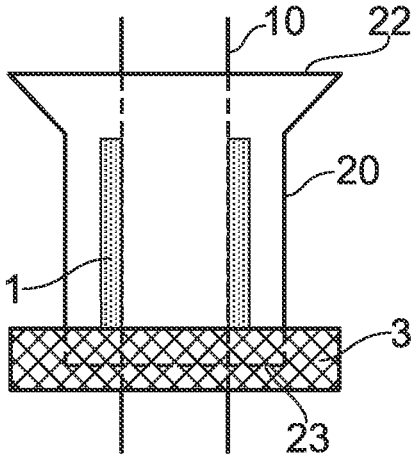
Figure 8F:
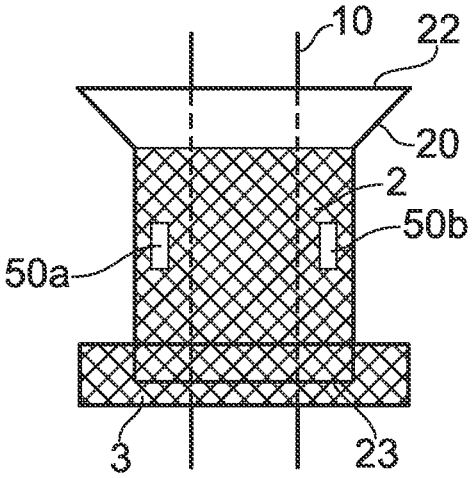

Demoulding agent 1 is then applied to a portion of the conductor 10 adjacent to the already formed part of the stabilising body 3, as shown in FIG. 8*e*. A further amount of the stabilising compound 2 is poured into the annulus 11 to substantially fill up the main portion 21 of the guide 20, and two sensor devices 50*a*, 50*b* are inserted therein. The first sensor device 50*a* is an EMAT sensor. The second sensor device 50*b* is an accelerometer. The sensor devices are capable of wireless communication with both onshore and offshore locations via an inspection instrument (not shown). Once again, the stabilising compound 2 gels forming the middle section of the stabilising body 3. This is shown in FIG. 8*f*.

Figure 8G:
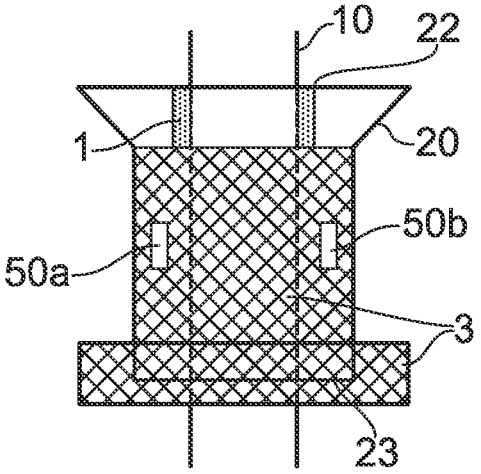

A further portion of the conductor 10, adjacent to the already formed part of the stabilising body 3, is coated with demoulding agent 1, as shown in FIG. 8*g*, and then the remaining part of the annulus 11 is filled with the stabilising compound 2, which is left to set and the top section of the stabilising body 3 is formed. The final full stabilising body 3, comprising sensor devices 50*a*, 50*b*, is shown in FIG. 8*h*.

An advantage of some embodiments of the present invention is that, the top section of the stabilising body 3 is cast after the middle section thereof is already gelled, thereby allowing to confirm that there are no issues with the middle section, before casting the top section of the stabilising body. The portion of the system where the middle section is located, i.e. defined by the substantially cylindrical main-portion part of the guide, is normally subject to the most lateral loading during the lifetime of the system.

Figure 8H:
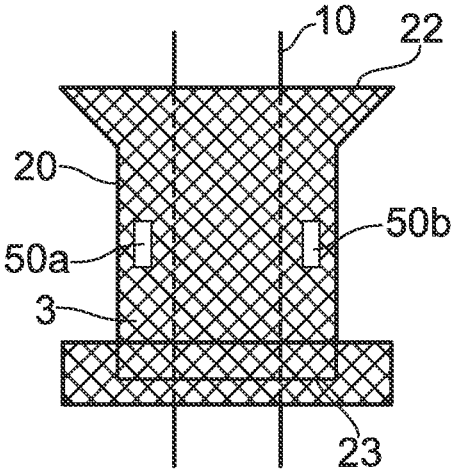

As shown in FIG. 8*h*, the stabilising body 3 is shaped and sized to substantially fit in the annulus between the conductor 10 and the guide 20, thereby comprising a conical portion proximally to the upper end 22 of the guide 20 and, additionally, comprises a flange-shaped radially extending portion below the lower end 23 of the guide 20.

A further advantage of some embodiments of the present invention is that the stabilising body 3 is formed in situ rather than pre-cast to size, thus its dimensions may be matched precisely with the dimensions of the annulus and scaled or adapted to fit the dimensions of any system.

In another example of the present invention, it may not be desirable to remove the centraliser 30 from the annulus 11. The centraliser 30 is left in the annulus 11, and the stabilising body 3 is cast with the centraliser 30 therein. The centraliser 30 secures the stabilising body 3 onto the conductor 10. Thus, the radially extending section of the stabilising body 3, below the lower end of the guide 20, is reduced in size or eliminated. In this example, if all welds/bolts of the centraliser fail then the demoulding agent may be applied to the guide 20 rather than to the conductor 10. The surface of the stabilising body 3 is thus bonded onto the outer surface of the conductor 10, but not to the inner surface of the guide 20, and the centraliser is not welded/bolted to the guide and. Thus, vertical motion of the conductor 10 in the guide 20 is still permitted.

A further advantage of some embodiments of the present invention is that the complexity of the method is minimised as it does not require the removal of the pre-existing centraliser.

A similar apparatus and method may be applied to a set up exemplified in FIG. 1*a* further comprising at least one thrust collar.

Figure 9A:
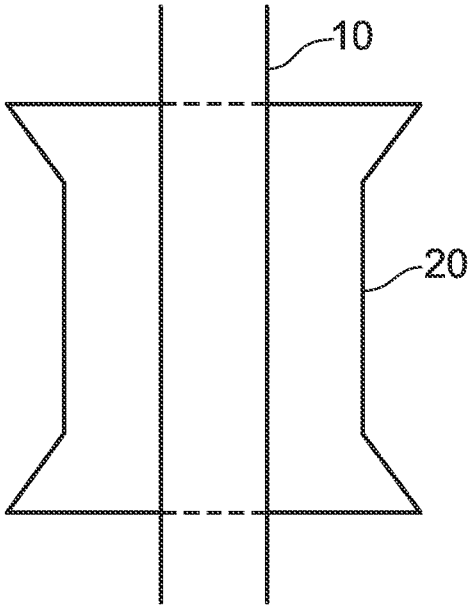
FIGS. 9*a*-9*c* are sequential side views of an embodiment of the present invention.
Figure 9B:
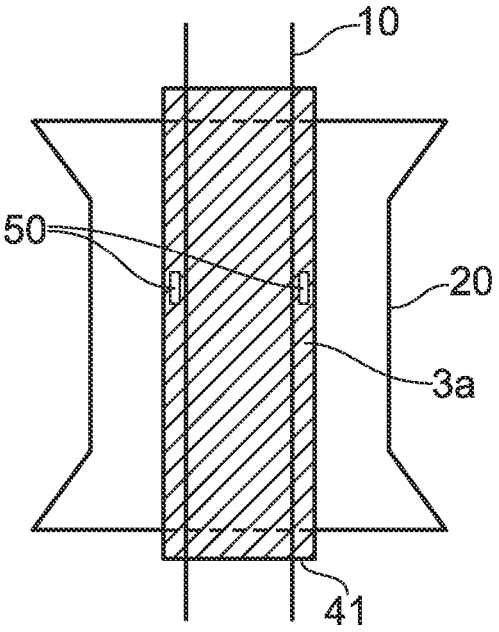
Figure 9C:
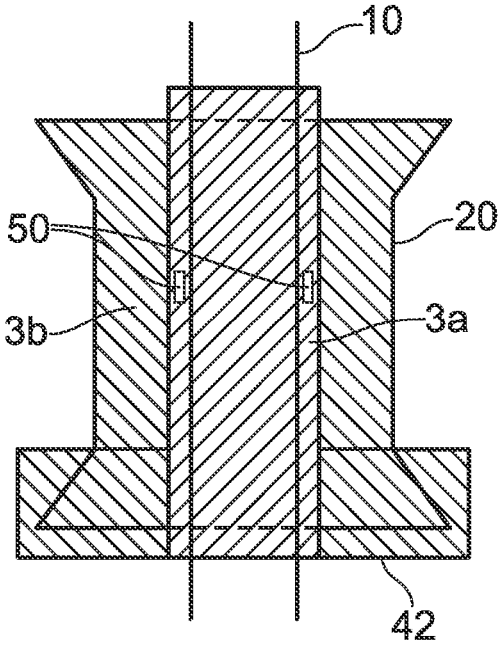

FIG. 9*a*-9*c* illustrates another example of the present invention, wherein the stabilising body 3 is cast in two parts, an inner stabilising body 3*a* and an outer stabilising body 3*b*. The casting of the inner and outer body may be done, for example, by means of separate moulds, an inner mould 41 and an outer mould 42. As shown in FIG. 9*b*, the inner mould 41 is installed onto the conductor 10, extending to a level below the lower end 23 of the guide 20 and proximally thereto. The inner mould 41 has a base of a smaller cross-sectional diameter than that of the main portion 21 of the guide 20, and a wall extending through the guide 21 and beyond the upper end 22 thereof. The inner mould 41 is coated with a demoulding agent (not shown) and then a stabilising compound is introduced therein. One or more sensor devices 50 are inserted into the stabilising compound. With no demoulding agent applied to the surface of the conductor 10, the stabilising compound sets and forms stabilising body 3*a* that is bonded to the surface of the conductor 10. Mould 41 is uninstalled once the stabilisation compound has cured. The outer mould 42, with inner surface coated with a demoulding agent, is then installed onto the conductor 10 as shown in FIG. 9*c*. The outer surface of the stabilising body 3*a* is also coated with the demoulding agent. A second stabilising compound is introduced therein, normally in a three-step process as that depicted in FIGS. 8*a*-8*h*. With no demoulding agent applied to the inner surface of the guide 20, the second stabilising compound sets and forms the outer stabilising body 3*b* that is bonded to the surface of the guide 20. Once the stabilising bodies 3*a*, 3*b* are formed, the mould 42 is uninstalled.

A further advantage of some embodiments of the present invention is that the inner and outer stabilising bodies 3*a*, 3*b* are bonded to the surfaces of the conductor 10 and guide 20, respectively. The lack of gaps between the surface of the conductor 10 and the stabilising body 3*a*, and similarly, between that of the guide 20 and the stabilising body 3*b* means that the, risk of crevice corrosion thereon is eliminated. Furthermore, the inner and outer stabilising bodies 3*a*, 3*b* are not bonded to one another. Thus, the conductor 10 is allowed to move vertically within the guide 20 with the only moving surfaces in contact being the outer surface of the inner body 3*a* and the inner surface of the outer body 3*b*. As a result of that, abrasion of the surface of the conductor 10 and/or guide 20 due to their relative motion would be eliminated, or at least substantially reduced.

Figure 10C:
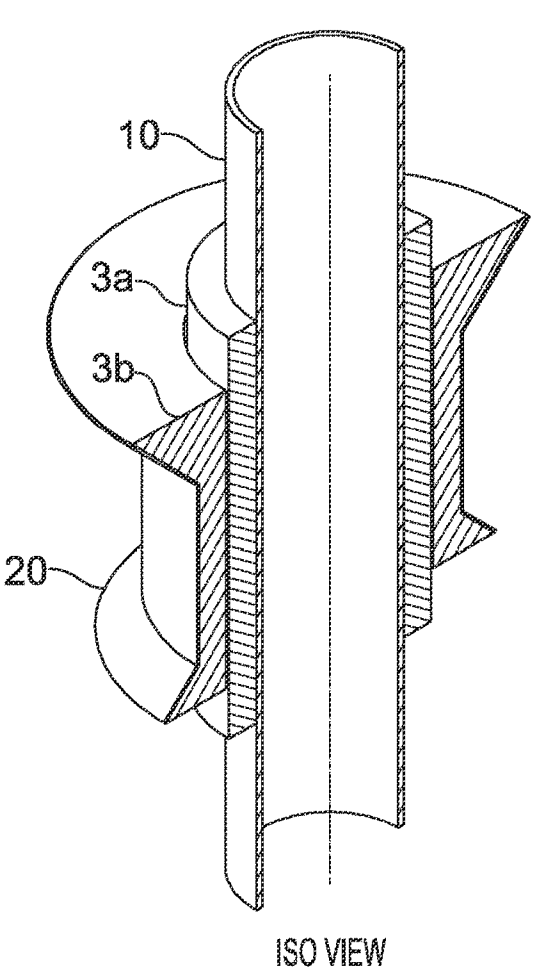
FIG. 10*c* is a perspective view of the FIG. 10*a* embodiment.
Figure 10B:
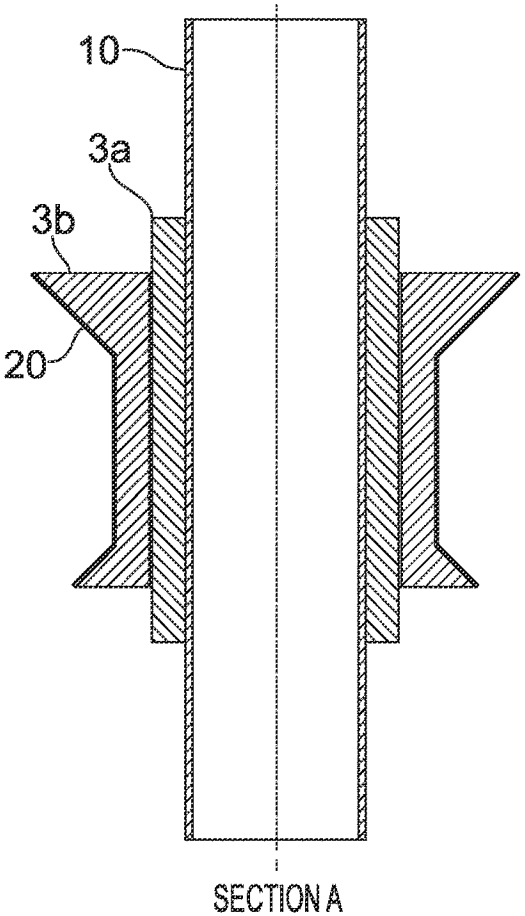
FIG. 10*b* is a sectional view through line A-A of FIG. 10*a*.
Figure 10A:
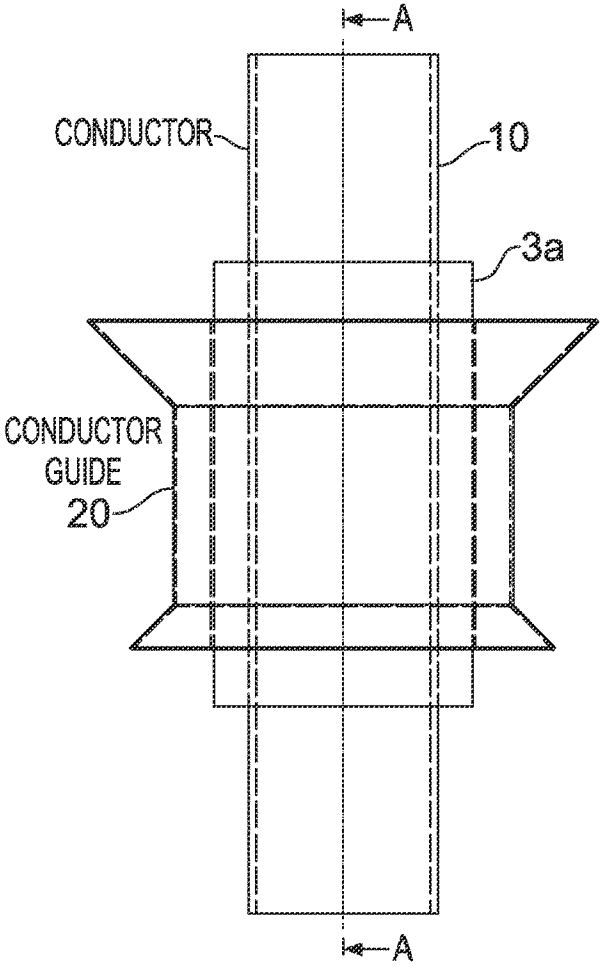
FIG. 10*a* is a side view of a further embodiments of the present invention.

FIGS. 10*a*-*c* show a further embodiment where an inner stabilising body 3*a* and an outer stabilising body 3*b* are provided between a guide 20 and a conductor 10, in a similar way as the FIG. 9 embodiment.

The invention claimed is:

1. A conductor assembly comprising:

a conductor of an offshore platform;

a guide surrounding the conductor, the guide extending from an upper end to a lower end and having a main portion therebetween;

a stabilising body defining a bore extending therethrough;

the conductor extending through the bore of the stabilising body;

the stabilising body provided between the conductor and the guide;

the stabilising body comprising an inner body and an outer body;

wherein the inner body is cast out of a material comprising a first elastic material component, and the outer body is cast out of a further material comprising a second elastic material component.

2. The conductor assembly of claim 1, wherein at least one of the first elastic material component and the second elastic material component comprises elastic polyurethane.

3. The conductor assembly of claim 1, wherein the outer surface of the inner body and the inner surface of the outer body are unbonded and thus moveable with respect to one another.

4. The conductor assembly of claim 1, wherein the inner body is bonded to the surface of the conductor and the outer body is bonded to the inner surface of the guide.

5. The conductor assembly of claim 1, wherein there is a space defined between the outer surface of the inner body and the inner surface of the outer body.

6. The conductor assembly of claim 5, wherein the dimensions of the space defined between the inner and outer stabilising bodies is selected to take account of the changing dimensions of said stabilising bodies over time, due to environmental and/or process conditions.

7. The conductor assembly as claimed in claim 5, wherein the space is a substantially vertical circumferential gap between said inner and outer stabilising bodies.

8. The conductor assembly of claim 5, wherein the outer diameter of the inner body is smaller than the inner diameter of the outer body.

9. The conductor assembly of claim 1, wherein at least one of the inner and outer bodies fill less than 50% of the cross-section of an annulus defined by the conductor and the guide.

10. The conductor assembly of claim 1, wherein the stabilising body comprises an upper end, a cylindrical main portion, a lower end and at least one of the upper and lower ends has a radially extending portion having a diameter greater than the main cylindrical portion.

11. The conductor assembly of claim 10, wherein the outer stabilising body comprises the radially extending portion.

12. The conductor assembly of claim 1, wherein the stabilising body has a tail section extending beyond at least one end of the guide.

13. The conductor assembly of claim 1, wherein the stabilising body comprises at least one sensor device.

14. The conductor assembly of claim 13, wherein the at least one sensor device comprises at least one of a material inspection sensor and a motion sensor.

15. The conductor assembly of claim 13, wherein the at least one sensor device comprises one or more wireless transmitters.

16. The conductor assembly of claim 15, further comprising an inspection instrument, the inspection instrument comprising at least one of a transmitter and a receiver, and configured to communicate with the one or more transmitters in the at least one sensor device.

17. The conductor assembly of claim 1, wherein the first and second elastic material components have different mechanical properties.

18. The conductor assembly of claim 1, wherein the inner and/or outer stabilising bodies have one or more of the following mechanical properties, upon installation: hardness in the range of 60-90 on the Shore A scale; tensile strength of 8-28 $N/mm^2$; elongation at break of 270-570%; tear propagation resistance of 9-68 $N/mm^{\wedge 2}$.

19. The conductor assembly of claim 1, wherein the inner body comprises two or more parts and the outer body comprises two or more parts.

20. The conductor assembly of claim 1, wherein the conductor comprises appurtenance, and wherein the outer diameter of the inner stabilising body is equal or greater than the maximum outer diameter of the said appurtenance along its length, and wherein the inner diameter of the outer stabilising body is larger than the outer diameter of the inner stabilising body.

21. The conductor assembly of claim 1, wherein the stabilising body is pre-cast in at least two parts.

22. The conductor assembly of claim 1 wherein the stabilising body is cast in situ.

23. The conductor assembly of claim 1, wherein the guide is located topside.

24. A method of stabilising a conductor in a guide in an offshore system, the guide provided around the conductor, thereby defining an annulus between the guide and the conductor, the guide extending from an upper end to a lower end, the method comprising the steps of:

providing a first mould at the lower end of the guide, with a base diameter smaller than the outer diameter of the lower end of the guide;

introducing a stabilising compound in a liquid form through the annulus towards the first mould;

allowing the stabilising compound to set and form a solid inner stabilising body at least partially between the conductor and the guide;

installing a second mould onto the conductor, the second mould having a base diameter equal to or larger than the diameter of the lower end of the guide;

introducing a stabilising compound in a liquid form through the annulus towards the second mould;

allowing the stabilising compound to set and form a solid outer stabilising body at least partially between the conductor and the guide.

25. The method of claim 24, wherein the second mould has a wider base diameter than the outer diameter of the lower end of the guide.

26. The method of claim 24, wherein the first mould has walls extending through the guide.

27. The method of claim 24, wherein the first mould is removed prior to the introduction of the second mould.

28. The method of claim 24, wherein the inner stabilising body is bonded to the outer surface of the conductor and the outer stabilising body is bonded to the inner surface of the guide.

29. The method of claim 28, including at least one of the following steps:

assessing the bond between the inner stabilising body and the conductor using one or more measurements taken circumferentially and/or longitudinally based on an ultrasonic reflection;

assessing the bond between the outer stabilising body and the guide using one or more measurements taken circumferentially and/or longitudinally based on an ultrasonic reflection.

* * * * *